US010002586B1

(12) United States Patent
Krishnan et al.

(10) Patent No.: US 10,002,586 B1
(45) Date of Patent: Jun. 19, 2018

(54) COMPRESSION OF DISPLAY DATA STORED LOCALLY ON A GPU

(75) Inventors: Sreenivas Krishnan, Santa Clara, CA (US); Koen Bennebroek, Santa Clara, CA (US); Karthik Bhat, Sunnyvale, CA (US); Stefano A. Pescador, Sunnyvale, CA (US); David G. Reed, Saratoga, CA (US); Brad W. Simeral, San Francisco, CA (US); Edward M. Veeser, Austin, TX (US)

(73) Assignee: NVIDIA CORPORATION, Santa Clara, CA (US)

( * ) Notice: Subject to any disclaimer, the term of this patent is extended or adjusted under 35 U.S.C. 154(b) by 2060 days.

(21) Appl. No.: 11/610,411

(22) Filed: Dec. 13, 2006

(51) Int. Cl.
*G09G 5/02* (2006.01)

(52) U.S. Cl.
CPC ..... *G09G 5/02* (2013.01)

(58) Field of Classification Search
None
See application file for complete search history.

(56) References Cited

U.S. PATENT DOCUMENTS 5,263,136 A 11/1993 DeAguiar et al.
5,421,028 A * 5/1995 Swanson ..... 712/42
5,506,967 A 4/1996 Barajas et al.
5,526,025 A 6/1996 Selwan et al.
5,734,744 A 3/1998 Wittenstein et al.
5,912,710 A 6/1999 Fujimoto
5,961,617 A 10/1999 Tsang
5,999,189 A 12/1999 Kajiya et al.
6,075,523 A 6/2000 Simmers
6,215,497 B1 * 4/2001 Leung ..... 345/419
6,366,289 B1 4/2002 Johns
6,704,022 B1 * 3/2004 Aleksic ..... 345/555
7,039,241 B1 5/2006 Van Hook
7,400,359 B1 * 7/2008 Adams ..... 348/441
2006/0053233 A1 3/2006 Lin et al.
2007/0257926 A1 11/2007 Deb

OTHER PUBLICATIONS

Office Action. U.S. Appl. No. 11/534,043. Dated Mar. 10, 2009.
Office Action. U.S. Appl. No. 11/534,107. Dated Mar. 17, 2009.
Office Action, U.S. Appl. No. 13/007,431 dated Mar. 30, 2011.

* cited by examiner

*Primary Examiner* — Antonio A Caschera
(74) *Attorney, Agent, or Firm* — Artegis Law Group, LLP

(57) ABSTRACT

Display data used in display frame generation are compressed for efficient storage in a local memory within a graphics processing unit. The compression technique used is difference encoding and before performing difference encoding, display data in RGB format are converted into YCbCr format. Since the component values of adjacent pixels in YCbCr format typically vary less than the component values of the same adjacent pixels in RGB format, converting the display data to YCbCr format before performing difference encoding improves the compression efficiency.

20 Claims, 9 Drawing Sheets

COMPRESSION OF DISPLAY DATA STORED LOCALLY ON A GPU

BACKGROUND OF THE INVENTION

Field of the Invention

Embodiments of the present invention relate generally to display frame generation and more specifically to a system and method for efficiently compressing display data used in display frame generation.

Description of the Related Art

Display data that are used in display frame generation include RGB color values for each of the pixels that make up the display frame. During display frame generation, a graphics processing unit ("GPU") reads display data from memory and generates an image that is displayed on a CRT or a similar display device from the display data. Some contemporary high performance mobile computing devices store display data locally on the GPU to reduce power consumption during display frame generation. One such system and method is described in U.S. patent application Ser. No. 11/534,128 entitled, "Screen Compression for Mobile Applications," filed Sep. 21, 2006, the entire contents of which are incorporated by reference herein. Configuring the GPU to store display data locally reduces memory traffic to main memory, thereby reducing power consumption.

When display data are stored locally on a GPU, the display data are compressed prior to storage to reduce the amount of local memory used by the display data. Since the size of the local memory substantially affects the cost of the GPU, and the cost of the GPU is a serious consideration for purchasing consumers, minimizing the size of the local memory is an important factor in the commercial viability of the GPU. Various compression methods may be used. According to one example known as difference encoding, differences between the display data of adjacent pixels are computed, and the difference values are stored rather than storing the display data itself, based on the assumption that adjacent pixels do not show much variation in color and that storing the difference values will require less memory than storing the display data itself.

SUMMARY OF THE INVENTION

The present invention provides an improved, more efficient way of compressing display data. According to an embodiment of the present invention, blocks of display data in RGB format are converted into YCbCr format and then difference encoded for efficient storage in an embedded memory of a processing unit. Since the colors of adjacent pixels in YCbCr format typically vary less than the colors of the same adjacent pixels in RGB format, converting the display data to YCbCr format before performing difference encoding improves the compression efficiency.

The present invention also provides a method of decompressing the display data so that a display frame can be generated therefrom. According to an embodiment of the present invention, a method for generating a display frame includes the steps of retrieving compressed display data in YCbCr format from the embedded memory of the processing unit, difference decoding the compressed display data in YCbCr format, converting the decoded display data in YCbCr format into display data in RGB format, and generating the display frame from the display data in RGB format.

A computing device according to an embodiment of the present invention includes a processing unit for generating a display frame from the uncompressed display data in RGB format, and an embedded memory of the processing unit that has memory spaces allocated for storing display data in YCbCr format in compressed form. The processing unit is configured to check if compressed display data in YCbCr format are stored in the embedded memory, and if so, generates the display frame from that data by difference decoding the compressed display data in YCbCr format, converting the decoded display data in YCbCr format into display data in RGB format, and generating a display frame from the display data in RGB format.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
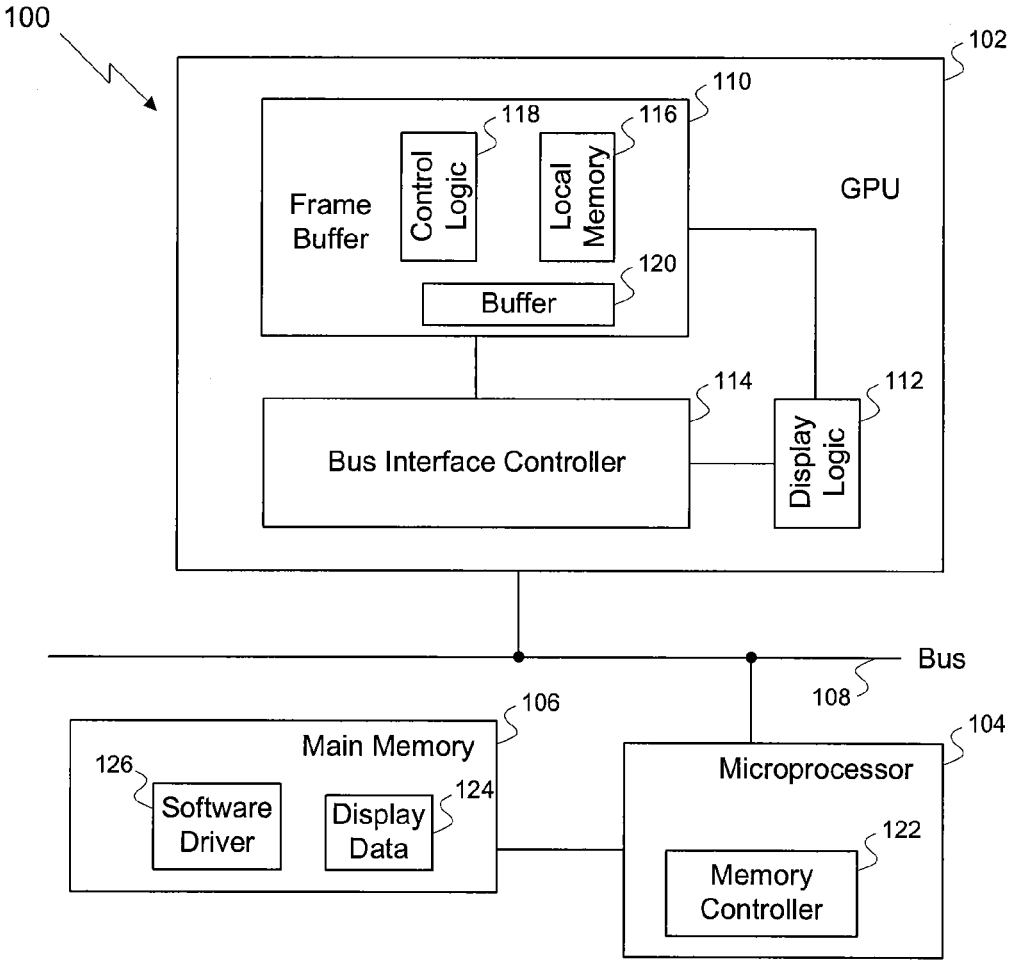
FIG. 1 illustrates a computing device in which embodiments of the present invention can be practiced.

FIG. 1 illustrates a computing device 100 in which embodiments of the present invention can be practiced. The computing device 100 includes a GPU 102, a central processing unit (CPU) 104, and a main memory 106. The GPU 102 is coupled to the CPU 104 over a bus 108, and includes a bus interface controller 114 which manages the GPU's communication with the CPU 104. The CPU 104 has a memory controller 122 through which it communicates with the main memory 106, and the main memory has stored therein display data 124, which comprise display data in uncompressed RGB format for generating a display frame, and a software driver 126 for the GPU 102. In other embodiments of the computing device 100, the memory controller 122 may be present outside the CPU 104 rather than being included in the CPU 104 as shown.

During initial display frame generation, the GPU 102 reads uncompressed display data in RGB format from the main memory 106, converts the display data in RGB format to YCbCr format, compresses the YCbCr display data using difference encoding, and stores the compressed display data in the local memory 116. It also uses the uncompressed display data in RGB format to generate the display frame. During subsequent display frame generation, the GPU 102 reads the compressed copy of the display data in YCbCr format from the local memory 116, decompresses the display data in YCbCr format using difference decoding, converts the decompressed display data in YCbCr format to RGB format, and uses the display data in RGB format to generate the display frame.

The conversion process from the RGB format to the YCbCr format is a lossless conversion that involves a weighting function known in the art, e.g., the "Standard 601" weighting function. Typically, variations in the Y, Cb and Cr components of two pixels are less than variations in the red, green and blue components of the same two pixels, because the YCbCr format encodes all color data in two chrominance components, Cb and Cr, and encodes all brightness data in a separate luminance component, Y, whereas the RGB format encodes color and brightness data into each of the R, G and B components. In other words, display data in the YCbCr format tend to vary less between adjacent pixels than display data in the RGB format. Since compression by difference encoding can be carried out with higher efficiency for display data with smaller differences than for display data with larger differences, difference encoding of display data in the YCbCr format improves the compression efficiency relative to difference encoding of display data in the RGB format.

The GPU 102 illustrated in FIG. 1 includes a frame buffer 110 and display logic 112 in addition to the bus interface controller 114. The frame buffer 110 includes the local memory 116, a buffer 120 and control logic 116 that processes requests for blocks of display pixels issued by display logic 112. When display logic 112 requests a block of display pixels, control logic 118 examines the local memory 116 to see if the display data associated with the requested block of display pixels are present in the local memory 116. If so, they are read from the local memory 116 in compressed form, decompressed, and converted from YCbCr format to RGB format before transmission to display logic 112. If not, they are read from the main memory 106 in uncompressed form, converted into YCbCr format, compressed, and stored in the local memory. In either case, the display data associated with the requested block of display pixels are transmitted in its uncompressed form to display logic 112. The method described herein is carried out block by block until display data of all blocks of display pixels are processed.

Figure 2:
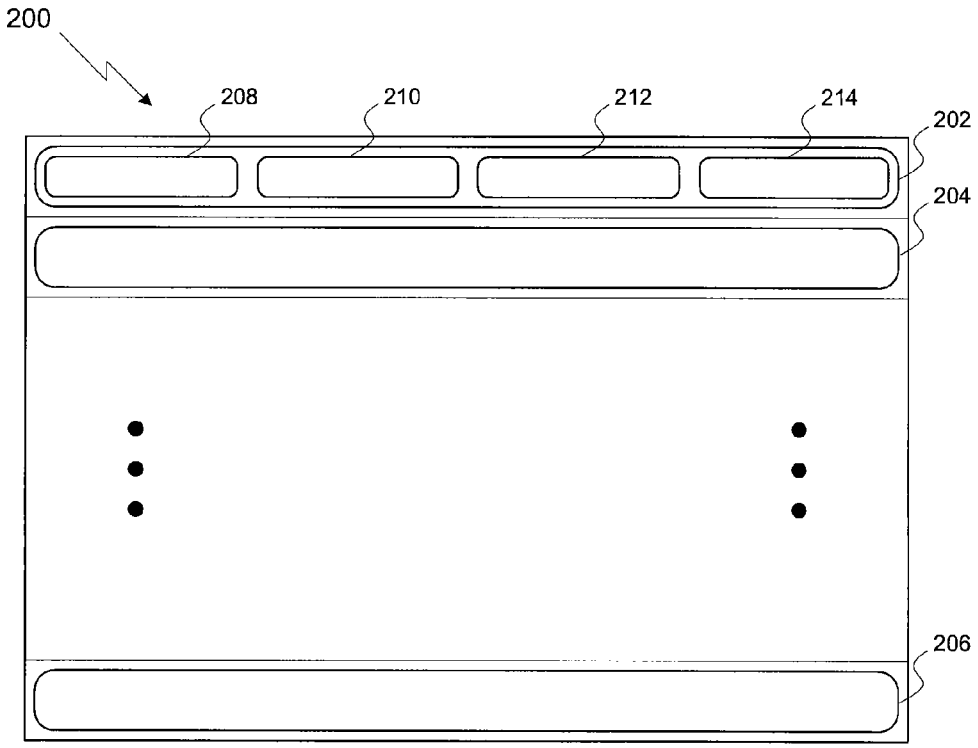
FIG. 2 is a conceptual illustration of multiple lines of multiple blocks of display pixels that make up a display.

FIG. 2 is a conceptual illustration of multiple lines of multiple blocks of display pixels that make up a display 200. As shown, display 200 is partitioned into a plurality of display lines 202, 204, 206, and each display line is partitioned into a plurality of blocks, each of which includes a plurality of display pixels. For example, the display line 202 is partitioned into blocks 208, 210, 212, 214. Other display lines, and the blocks included within the other display lines, are not shown in FIG. 2 for simplicity. Although display 200 shows four blocks per display line, any technically feasible number of blocks may be included within each display line.

The local memory 116 is partitioned into a plurality of local memory buffers, with one local memory buffer allocated to each block in display 200. When display logic 112 requests a block of display pixels for display frame generation, that request is made using a screen address (e.g., pixel coordinates) for that block. In response, control logic 118 determines whether the requested block of display pixels are present in the local memory 116 by checking the local memory buffer that corresponds to the requested block of display pixels.

Figure 3:
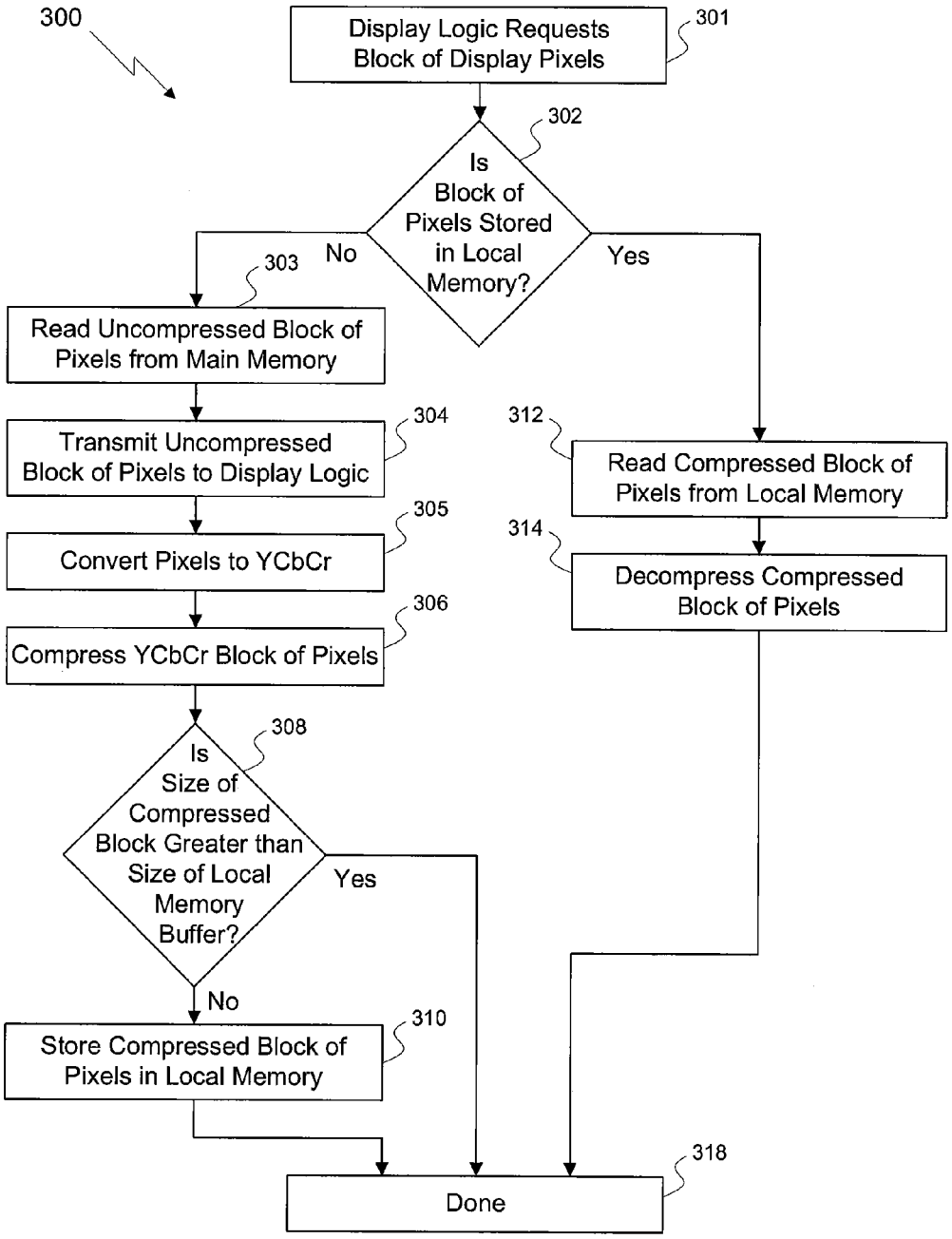
FIG. 3 illustrates a flowchart of a method for reading a block of display pixels during frame generation.

FIG. 3 illustrates a flowchart of a method 300 for reading a block of display pixels during frame generation. As shown, the method 300 begins at step 301 with display logic 112 requesting a block of display pixels. In step 302, control logic 118 determines whether the block of display pixels to be read are stored in the local memory 116. If the block of display pixels is not stored in the local memory 116, the block of display pixels is read from the main memory 106 in uncompressed form (step 303). The uncompressed block of pixels are then transmitted to display logic 112 in step 304, and translated from the RGB format to the YCbCr format in step 305. In step 306, the block of display pixels in the YCbCr format is compressed. The compression method is described in further detail below with reference to FIGS. 4A and 4B. In step 308, control logic 118 determines whether the size of the compressed block of display pixels is larger than the size of the local memory buffer corresponding to that block of display pixels. If control logic 118 determines that the size of the compressed block of display pixels is not larger than the size of the corresponding local memory buffer, the method continues to step 310 where the compressed block of display pixels is stored in the corresponding local memory buffer. Otherwise, the compressed block of display pixels is not stored locally. The method concludes in step 318.

Figure 6A:
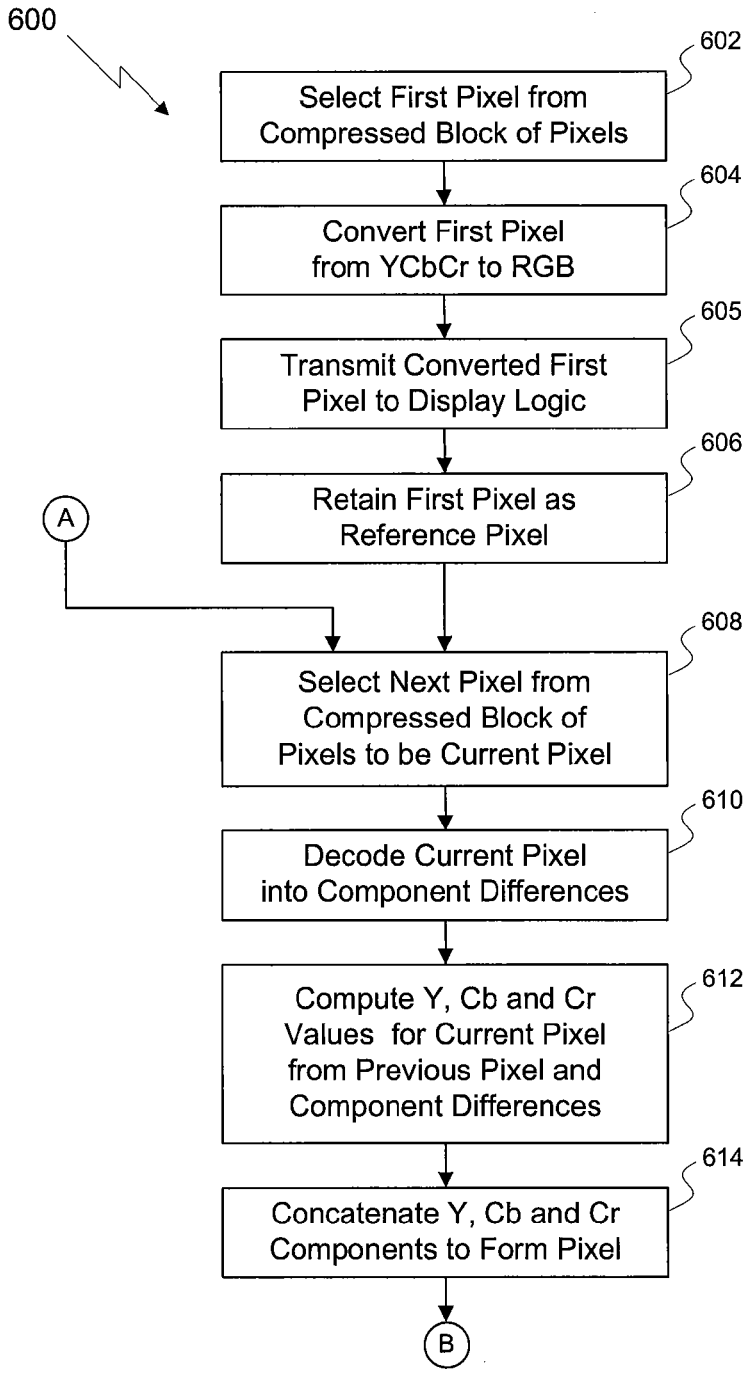
FIGS. 6A and 6B illustrate a flowchart of a method for decompressing a compressed block of display pixels and converting them from the YCbCr format to the RGB format.
Figure 6B:
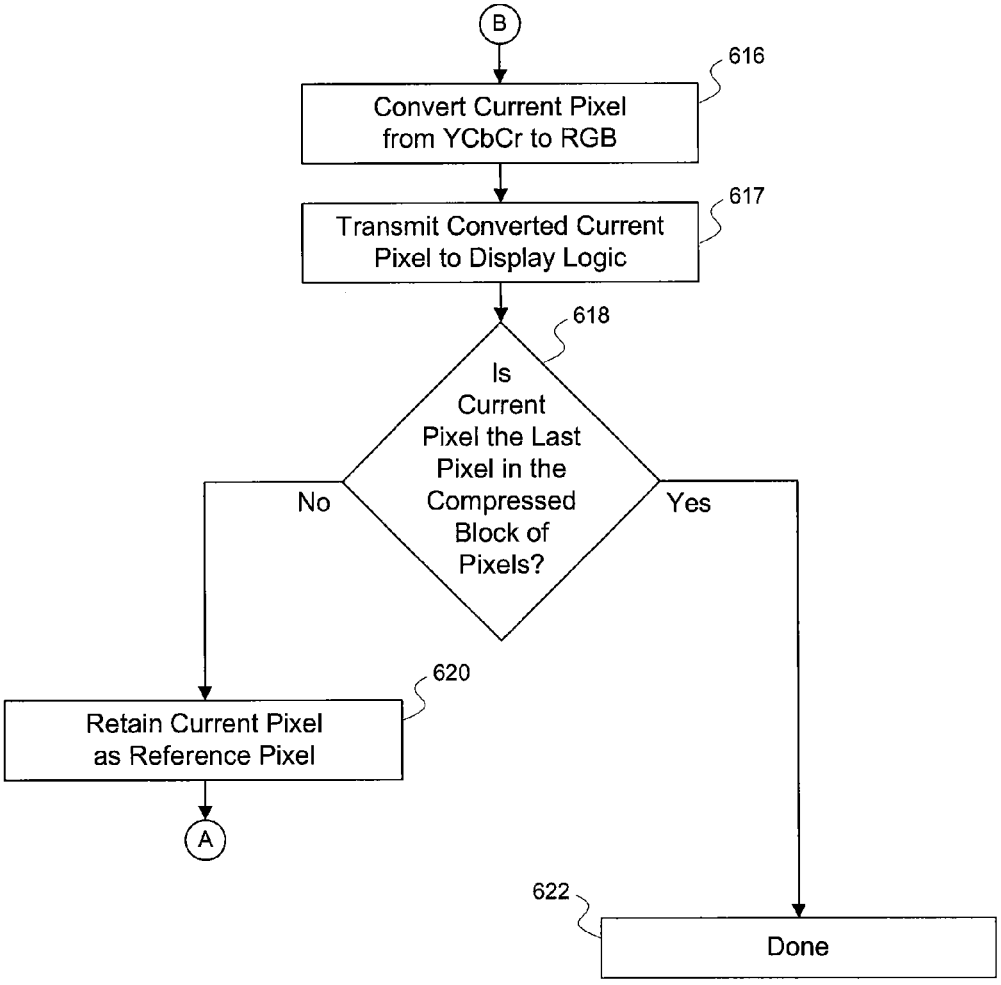

Returning to step 302, if the requested block of display pixels is stored in the local memory 116, this block of display pixels is read from the local memory 116 in compressed form (step 312) and decompressed (step 314). As each display pixel is being decompressed, it is also converted from the YCbCr format to the RGB format and transmitted to display logic 112. The decompression and YCbCr-to-RGB format conversion steps are shown in FIGS. 6A and 6B. The method concludes in step 318.

Figure 4A:
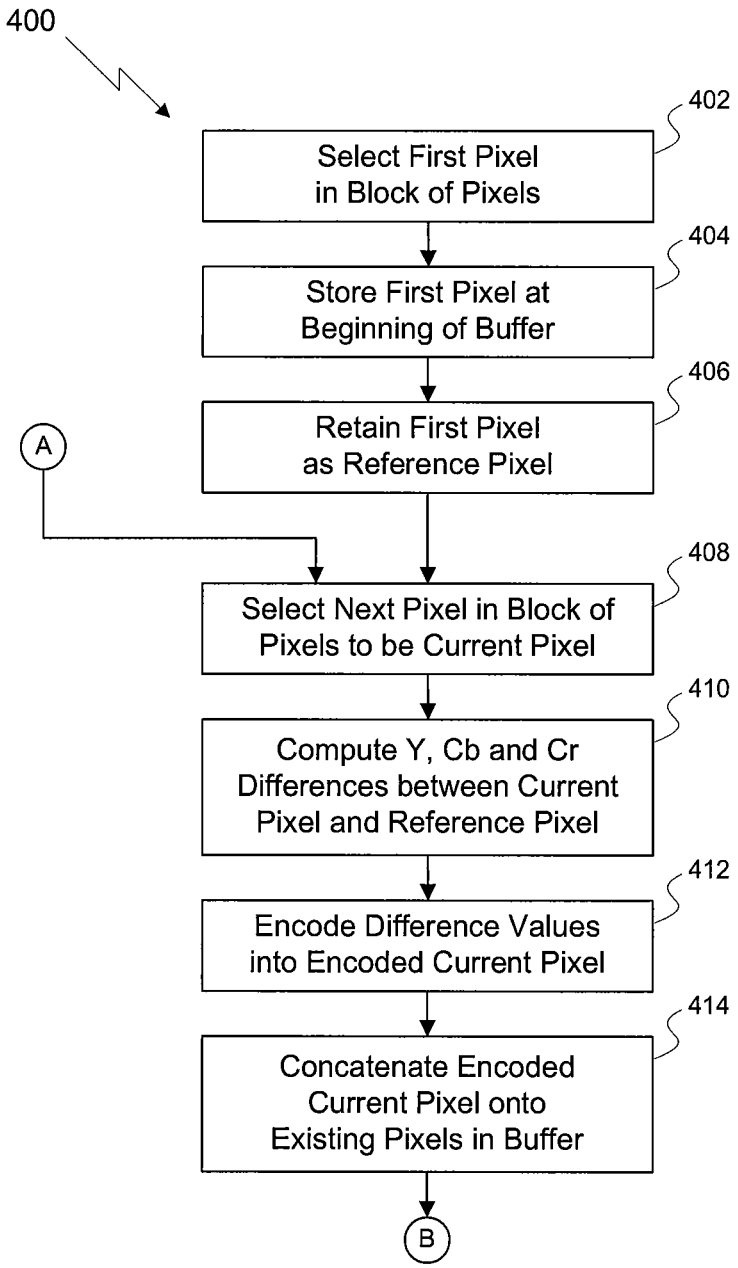
FIGS. 4A and 4B illustrate a flowchart of a method for compressing a block of display pixels.
Figure 4B:
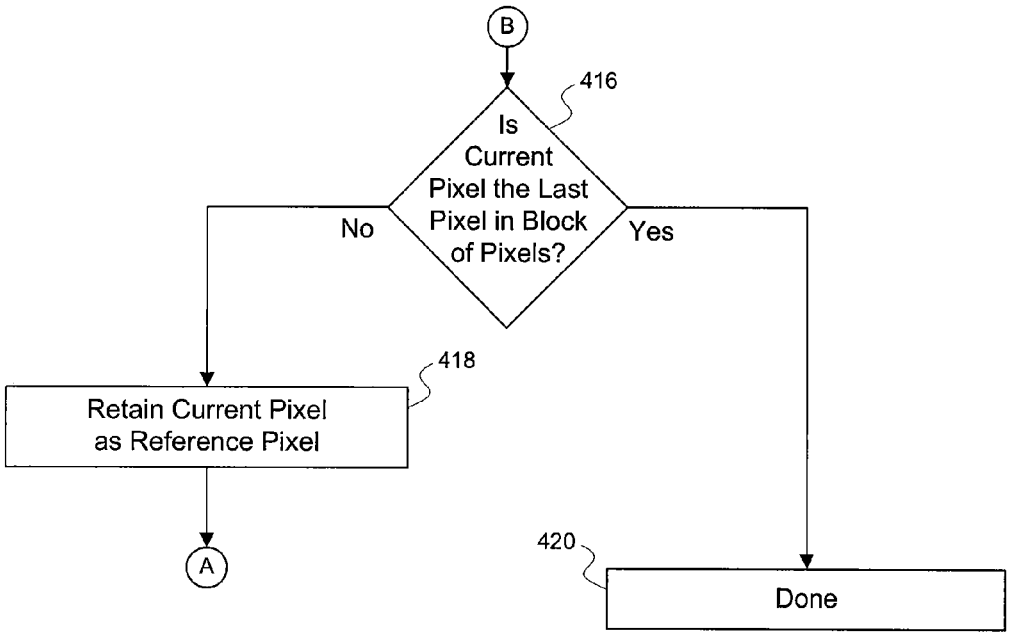

FIGS. 4A and 4B illustrate a flowchart of a method 400 for compressing a block of display pixels. Compressing a block of display pixels starts by selecting the first pixel in the block for processing (step 402). In step 404, the Y, Cb and Cr component values for the first display pixel are stored at the beginning of the buffer 120. In step 406, the first display pixel is retained as the reference pixel for computing the differences in Y, Cb and Cr component values between it and the next pixel. The next pixel in the block of display pixels is then selected as the current pixel for processing (step 408). In step 410, the differences in Y, Cb and Cr component values between the current pixel and the reference pixel are computed. For example, differences between the Y component of the current pixel and the Y component of the reference pixel, as well as differences between the Cb and Cr components of the current pixel and the reference pixel, are computed.

In step 412, the differences in Y, Cb and Cr component values computed in step 410 are encoded to form an encoded current pixel. The encoding method is described in further detail below with reference to FIG. 5. In step 414, the encoded current pixel is concatenated onto existing data in the buffer 120. In step 416, control logic 118 determines whether the current pixel being processed is the last pixel in the block of display pixels. If the current pixel is not the last pixel in the block of display pixels to be compressed, the method continues by processing the next pixel in the block of display pixels in steps 418 and 408-414. In step 418, the current pixel is retained as the reference pixel, before continuing to step 408 where the next pixel in the block of display pixels is selected for processing. If the current pixel is the last pixel in the block of display pixels to be compressed, compression of the block of display pixels is complete and the method terminates in step 420.

Figure 5:
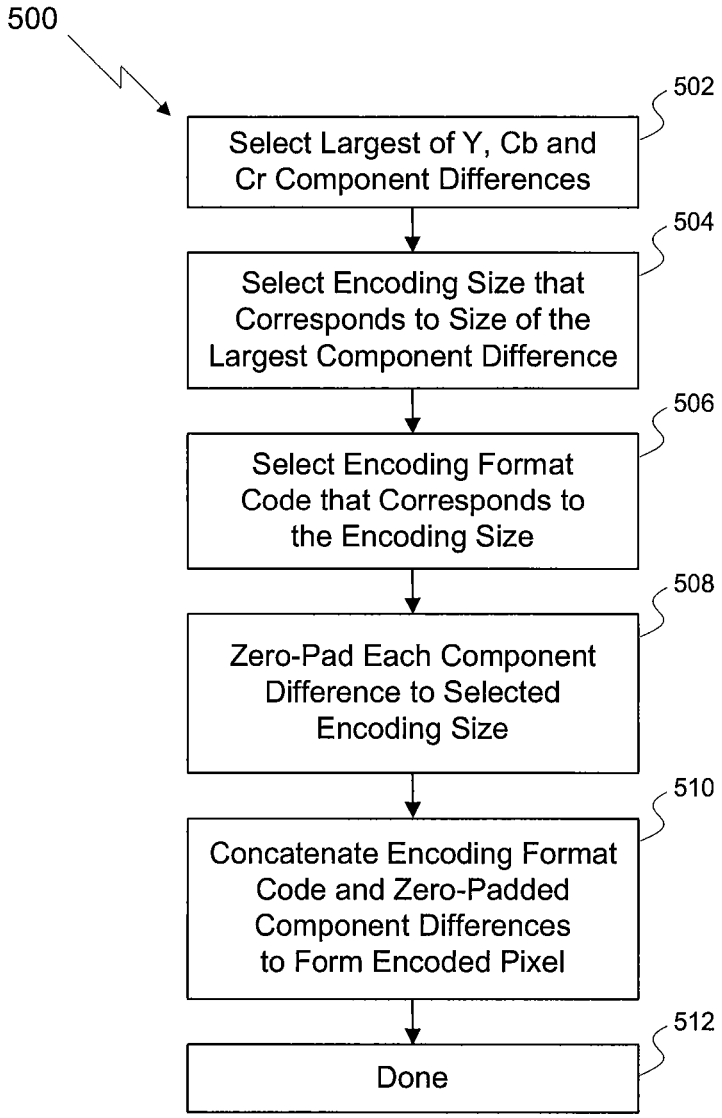
FIG. 5 illustrates a flowchart of a method for encoding pixels.

FIG. 5 illustrates a flowchart of a method 500 for encoding the differences in Y, Cb and Cr component values between the current pixel and the reference pixel into an encoded pixel. As shown, the method 500 begins at step 502, where the Y, Cb and Cr component difference with the greatest magnitude is selected for use in determining the format of the encoded pixel. For example, if the Y, Cb and Cr component differences from step 410 were binary values "1010," "101" and "1," respectively, "1010" is selected as the largest of the three component differences in step 502. In step 504, an encoding size is selected. In the embodiment of the invention illustrated herein, the encoding size is selected from four encoding sizes. A first encoding size corresponds to a component difference of zero and is represented by Y, Cb and Cr component differences of zero length. Thus, the first encoding size is selected when the Y, Cb and Cr components for the current pixel and reference pixel are identical. Second, third and fourth encoding sizes correspond to component differences whose sizes are one-to-three, four or five, and from six-to-eight bits, respectively. For the example described in step 502, where "1010" was selected as the largest of the three component differences, the third encoding size is selected because "1010" is represented in four bits. In alternative embodiments of the invention, any technically feasible number and configuration of encoding sizes may be used without departing from the scope of the invention.

In step 506, a format code corresponding to the encoding size is determined. In the embodiment of the invention illustrated herein, format codes of "0," "10," "110" and "1110" correspond to the first, second, third and fourth encoding sizes described in step 504, respectively. In alternative embodiments of the invention, any technically feasible format codes may be used without departing from the scope of the invention. In the example given herein, where the component differences are encoded with the third encoding size, "110" is the corresponding format code. In step 508, the component differences are zero-padded to extend the component differences to the encoding size. In the example given herein, with component differences of "1010," "101" and "1" and an encoding size of four selected in step 506, the zero-padded component differences are "1010," "0101" and "0001," respectively. In step 510, the zero-padded component differences computed in step 508 are concatenated onto the format code to form the encoded pixel. In the example given herein, with a format code of "110" and zero-padded component differences for Y, Cb and Cr of "1010," "0101" and "0001," respectively, the resulting encoded pixel value is "110101001010001." In step 512, the method concludes.

FIGS. 6A and 6B illustrate a flowchart of a method 600 for decompressing a compressed block of display pixels and converting them from the YCbCr format to the RGB format. As shown, the method 600 begins at step 602, where the first pixel in the compressed block of display pixels to be decompressed is selected. In step 604, the first pixel is converted from the YCbCr format to the RGB format. In step 605, the first pixel in the RGB format is transmitted to display logic 112. In step 606, the first pixel is retained as the reference pixel for subsequent difference decoding computations. In step 608, a next pixel in the compressed block of pixels is selected as the current pixel for processing. In step 610, the current pixel is decoded to obtain the Y, Cb and Cr component differences between it and the reference pixel. The decoding method is described in further detail below with reference to FIG. 7. In step 612, the Y, Cb and Cr components are computed for the current pixel by adding the Y, Cb and Cr components of the reference pixel to the component differences decoded in step 610. In step 614, the Y, Cb and Cr components of the current pixel computed in step 614 are concatenated to form the current pixel. In step 616, the current pixel is converted from the YCbCr format to the RGB format. In step 617, the current pixel in the RGB format is transmitted to display logic 112. In step 618, control logic 120 determines whether the current pixel being processed is the last pixel in the compressed block of display pixels. If the current pixel is not the last pixel in the compressed block of display pixels, the method continues by processing the next pixel in the compressed block of display pixels in steps 620 and 608-616. In step 620, the current pixel is retained as the reference pixel and the method continues to step 608 where the next pixel in the compressed block of display pixels is selected as the current pixel for processing. If the current pixel is the last pixel in the compressed block of display pixels, decompression of the compressed block of display pixels is complete and the method terminates in step 622.

Figure 7:
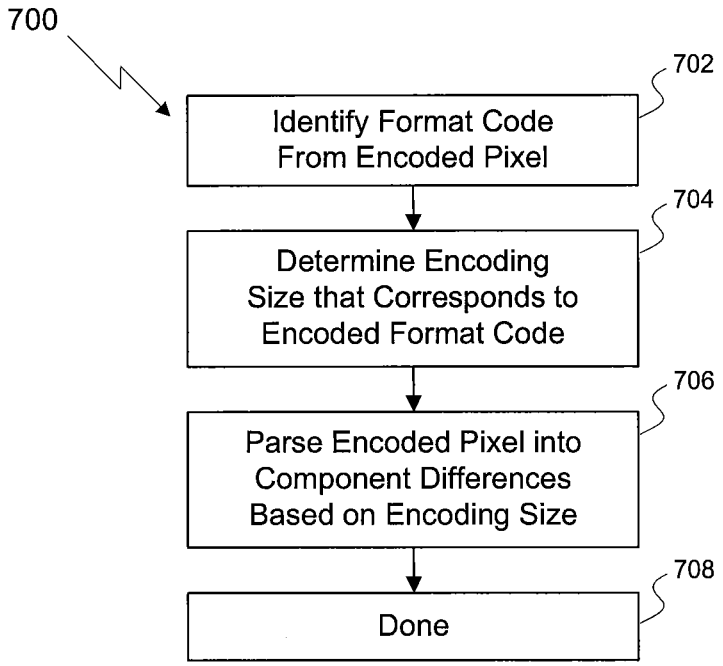
FIG. 7 illustrates a flowchart of a method for decoding pixels.

FIG. 7 illustrates a flowchart of a method 700 for decoding an encoded pixel into Y, Cb and Cr component differences. As shown, the method 700 begins at step 702, where the format code is identified. As previously described, format codes of "0," "10," "110" and "1110" at the start of the encoded pixel correspond to the first, second, third and fourth encoding sizes, respectively. These format codes are uniquely identifiable by locating the first zero bit in the encoded pixel and counting the preceding number of one-bits. Zero, one, two or three preceding one-bits correspond to the first, second, third and fourth encoding sizes, respectively. In step 704, the format code identified in step 702 is translated into the encoding size for the pixel. In step 706, the encoded pixel is parsed into the format code, which is no longer needed, and the Y, Cb and Cr component differences between the current pixel and the reference pixel. The method concludes in step 708.

One advantage of the disclosed method is that higher compression efficiency is achieved by converting display data from RGB format to YCbCr format before compressing the display data. Higher efficiency is achieved because the conversion from RGB format to YCbCr format causes the variance between adjacent pixels for each of the Y, Cb and Cr components to be less than the variance between adjacent pixels for each of the R, G and B components. Reducing the variance between pixels reduces the size of the difference-encoded pixel, thereby improving the compression efficiency of the display data and allowing for more efficient use of the embedded memory.

While the foregoing is directed to embodiments of the present invention, other and further embodiments of the invention may be devised without departing from the basic scope thereof. The scope of the present invention is determined by the claims that follow.

We claim:

1. A method for generating a display frame from display data in RGB format, comprising the steps of:

retrieving compressed display data in YCbCr format from a memory based on a pixel data request received from display logic within a processing unit;

decompressing the compressed display data in YCbCr format to produce decompressed display data in YCbCr format by performing, for each pixel in the display data in YCbCr format, the steps of:

extracting Y, Cb, and Cr difference values for the pixel based on a format code included in the pixel, wherein the format code indicates an encoding size associated with the Y, Cb, and Cr difference values, generating decompressed Y, Cb, and Cr values for the pixel based on a reference pixel and the Y, Cb, and Cr difference values, and generating a decompressed pixel by concatenating the decompressed Y, Cb, and Cr values;

converting the decompressed display data in YCbCr format into display data in RGB format; and generating a display frame from the display data in RGB format for output to a display device.

2. The method according to claim 1, wherein the steps of retrieving, decompressing, converting, and generating are carried out in the processing unit, and the memory from which the compressed display data in YCbCr format are retrieved is embedded in the processing unit.

3. The method according to claim 2, wherein the processing unit comprises a graphics processing unit.

4. The method according to claim 1, wherein the compressed display data in YCbCr format are generated through the steps of:

retrieving uncompressed display data in RGB format from another memory;

converting the uncompressed display data in RGB format into uncompressed display data in YCbCr format; and compressing the uncompressed display data in YCbCr format.

5. The method according to claim 4, wherein the uncompressed display data in YCbCr format includes YCbCr values for a plurality of pixels, and the step of compressing includes, for each pixel in the plurality of pixels, the steps of:

computing Y, Cb, and Cr difference values as the differences between Y, Cb, and Cr values associated with the reference pixel and corresponding Y, Cb, and Cr values associated with the pixel, and generating a compressed pixel by encoding the Y, Cb, and Cr difference values based on the format code.

6. The method according to claim 1, wherein the compressed display data in YCbCr format include difference-encoded YCbCr values for a plurality of pixels, and the step of decompressing includes the step of decoding the difference-encoded YCbCr values for the plurality of pixels.

7. The method according to claim 6, wherein the display data include a plurality of blocks of display data, each block representing display data for a group of pixels, and the steps of retrieving, decompressing, and converting are carried out separately for each block of display data.

8. The method according to claim 7, wherein the display data for a group of pixels include color component values for all the pixels in said group.

9. A computer-implemented method for generating a sequence of display frames using a graphics processing unit that includes an embedded memory, wherein the graphics processing unit is included in a computing device that also includes a main memory, the method comprising the steps of:

if display data for generating a display frame are not stored in the embedded memory, retrieving uncompressed display data in RGB format from the main memory and generating a display frame therefrom; and if display data for generating a display frame are stored in the embedded memory, retrieving compressed display data in YCbCr format from a memory based on a pixel data request received from display logic within a processing unit, decompressing the compressed display data in YCbCr format to produce decompressed display data in YCbCr format by performing, for each pixel in the display data in YCbCr format, the steps of:

extracting Y, Cb, and Cr difference values for the pixel based on a format code included in the pixel, wherein the format code indicates an encoding size associated with the Y, Cb, and Cr difference values, generating decompressed Y, Cb, and Cr values for the pixel based on a reference pixel and the Y, Cb, and Cr difference values, and generating a decompressed pixel by concatenating the decompressed Y, Cb, and Cr values, converting the decompressed display data in YCbCr format into display data in RGB format, and generating a display frame from the display data in RGB format for output to a display device.

10. The method according to claim 9, wherein the compressed display data in YCbCr format stored in the embedded memory are generated from the uncompressed display data in RGB format that were previously retrieved from the main memory.

11. The method according to claim 10, further comprising the steps of:

converting the uncompressed display data in RGB format that were previously retrieved from the main memory into uncompressed display data in YCbCr format;

compressing the uncompressed display data in YCbCr format, and storing the compressed display data in YCbCr format in the embedded memory.

12. The method according to claim 11, wherein the compressed display data in YCbCr format include difference-encoded YCbCr values for a plurality of pixels, and the step of decompressing includes the step of decoding the difference-encoded YCbCr values for the plurality of pixels.

13. The method according to claim 9, wherein the display data include a plurality of blocks of display data, each block representing display data for a group of pixels, and the steps of retrieving, decompressing, and converting in the case where the display data for generating a display frame are stored in the embedded memory, are carried out separately for each block of display data.

14. The method according to claim 13, wherein the display data for a group of pixels include color component values for all the pixels in said group.

15. A computing device, comprising:

a main memory having stored therein uncompressed display data in RGB format; and a processing unit for generating a display frame for output to a display device from the uncompressed display data in RGB format, wherein the processing unit includes an embedded memory and is configured to:

convert the uncompressed display data in RGB format into uncompressed display data in YCbCr format, compress the display data in YCbCr format to produce compressed display data in YCbCr format by performing, for each pixel in the display data in YCbCr format, the steps of:

determining a reference pixel in the display data in YCbCr format, computing Y, Cb, and Cr difference values as the differences between Y, Cb, and Cr values associated with the reference pixel and corresponding Y, Cb, and Cr values associated with the pixel, and generating a compressed pixel by encoding the Y, Cb, and Cr difference values based on a format code, wherein the format code indicates an encoding size associated with the Y, Cb, and Cr difference values, and is included in the compressed pixel; and store the compressed display data in YCbCr format in the embedded memory.

16. The computing device according to claim 15, wherein the processing unit is configured to generate the display frame from the uncompressed display data in RGB format stored in the main memory if the compressed display data in YCbCr format are not stored in the embedded memory, and to generate the display frame from the compressed display data in YCbCr format stored in the embedded memory if the compressed display data in YCbCr format are stored in the embedded memory.

17. The computing device according to claim 16, wherein the processing unit is configured to generate the display frame from the compressed display data in YCbCr format stored in the embedded memory by decompressing the compressed display data in YCbCr format, converting the decompressed display data in YCbCr format into display data in RGB format, and generating the display frame from the display data in RGB format.

18. The computing device according to claim 17, wherein the processing unit is configured to compress the display data in YCbCr format using difference encoding and to decompress the display data in YCbCr format using difference decoding.

19. The computing device according to claim 15, wherein the processing unit comprises a graphics processing unit.

20. The computing device according to claim 15, wherein the display data include a plurality of blocks of display data, each block representing display data for a group of pixels, and the embedded memory has a plurality of buffers, each of which is allocated to one of the blocks of display data.

* * * * *